US007306497B2

(12) United States Patent
Buzzi

(10) Patent No.: US 7,306,497 B2
(45) Date of Patent: Dec. 11, 2007

(54) BOAT PROPELLER AND METHOD FOR ASSEMBLING THE SAME

(75) Inventor: Fabio Buzzi, Oggiono (IT)

(73) Assignee: FB Design S.R.L., Annone Brianza (IT)

( * ) Notice: Subject to any disclaimer, the term of this patent is extended or adjusted under 35 U.S.C. 154(b) by 0 days.

(21) Appl. No.: 11/439,448

(22) Filed: May 24, 2006

(65) Prior Publication Data

US 2006/0270287 A1 Nov. 30, 2006

(30) Foreign Application Priority Data

May 27, 2005 (IT) ..... MI2005A1001

(51) Int. Cl.
*B63H 1/14* (2006.01)

(52) U.S. Cl. ..... 440/49; 416/245 A

(58) Field of Classification Search ..... 440/49, 440/50; 416/244 B, 245 A
See application file for complete search history.

(56) References Cited

U.S. PATENT DOCUMENTS

| | | | | |
|---|---|---|---|---|
| 2,953,208 | A * | 9/1960 | O'Connor | 416/207 |
| 6,042,333 | A * | 3/2000 | Day | 416/244 B |
| 6,312,223 | B1 * | 11/2001 | Samuelsson | 416/240 |
| 6,422,905 | B2 * | 7/2002 | Samuelsson | 440/49 |
| 6,506,019 | B2 * | 1/2003 | Lin et al. | 416/244 B |

* cited by examiner

*Primary Examiner*—Lars A. Olson
(74) *Attorney, Agent, or Firm*—Nixon & Vanderhye P.C.

(57) ABSTRACT

The present invention relates to a boat propeller and the assembly method therefor. The propeller comprises a hub and a plurality of separated blades to be integrally coupled with corresponding seats that are formed in the hub. Advantageously, during the assembly stage of the propeller, the blades can be orientated in the respective seats, each about its own axis. The method for assembling the propeller comprises the steps of orientating the blades according to a determined pitch angle before they are definitely fixed to the hub.

17 Claims, 5 Drawing Sheets

Fig.1

BOAT PROPELLER AND METHOD FOR ASSEMBLING THE SAME

This application is a new U.S. utility application claiming benefit of IT MI2005A001001 filed May 27, 2005, the entire contents of which are hereby incorporated by reference.

The present invention relates to a boat propeller and the assembly method thereof.

Traditionally, boat propellers comprise a plurality of blades that are integral with a central hub. The hub is arranged to be coupled with a boat drive shaft. The blades can be made as one piece with the hub, for example by means of steel or bronze casting. Traditional sea propellers that are made as one piece have a fixed geometry, and thus the pitch angle to the hub is defined during the design step. Accordingly, in order to provide propellers suitable to the different boats available, a plurality of propellers needs to be made which differ by size, blade geometry and pitch angle, with an evident increase in the manufacturing cost. The manufacturing time also increases, as the manufacturing steps of a propeller comprise: making the pattern, carrying out the casting of the same, carrying out the subsequent mechanical and finishing processing.

Alternatively, the blades can be manufactured separately of the hub and be adjusted to the hub during the step of assembling the propeller. The Japanese Patent JP 1237068 relates to a sea propeller of this kind. The coupling between the blades and the hub is of a dovetail type. The pitch angle, i.e. the angle defining the propeller pitch, is set during the design stage and depends on the geometry of the coupling between the blades and the hub.

Propellers equivalent to the propeller according to the Japanese Patent JP 1237068 provide the possibility that blades having different geometries are coupled to the same hub. The blades only need to have a dovetail portion to be engaged with the hub. Disadvantageously, this type of propeller does not also provide a great flexibility in terms of pitch angle to the hub, as this angle is defined by the geometry of the dovetail portion of each blade and this geometry is defined during the design stage of the blades.

The need has been felt for a long time to have propellers that are easy to manufacture and with a pitch, which depends on the pitch angle, that can be adapted to different requirements during the manufacturing stage of the propeller.

Some traditional propellers are further provided with variable pitch blades. The propellers of this kind are provided with blades moving relative to the hub, i.e. the propeller is provided with suitable actuators which orientate the blades about its axis while the propeller is operating. By varying the orientation of a blade, the pitch angle is modified, and consequently the propeller pitch and the performance thereof are also modified. The propellers provided with variable pitch blades are expensive and difficult to manufacture and require suitable measures to avoid that the actuators controlling the blade pitch are subjected to corrosion. Therefore, the maintenance of this kind of propellers is often expensive and complicated. Traditional propellers of this kind, furthermore, are not well suited to work as surface propellers, since this configuration provides that the blades are subjected to high flexural load because of the interaction with incoming and outgoing water.

The present invention relates to the fixed pitch propellers, i.e. those propellers that are provided with blades, of which the pitch angle to the hub does not vary while the propeller is operating.

The object of the present invention is to provide a sea propeller that solves the drawbacks of the traditional fixed pitch propellers in an effective manner, while being easy to manufacture and cost-effective.

A further object of the present invention is to provide a boat propeller that can be manufactured in a short time with the desired pitch, preferably from mass-produced components.

It is yet another object of the present invention to provide a method for manufacturing a sea propeller as described above, with the desired pitch, in a short-time.

These and other objects are achieved by the present invention, which relates to a boat propeller comprising a hub and a plurality of separated blades to be integrally coupled with corresponding seats formed in said hub, characterized in that, during the assembly step of the propeller, each of said blades can be orientated in said seats about its own axis.

Advantageously, the propeller according to the present invention, which is suitable for submerged propeller applications and mainly surface propeller applications, can be assembled in a short time according to the desired pitch. In fact, when the propeller is assembled, each blade can be orientated in the corresponding hub seat according to any angle ranging from zero and three hundred and sixty degrees (unless an interference between the blades occurs) or, alternatively, it can be orientated according to a sequence of discrete angles, in predefined positions. When the blades have been adjusted according to the desired angle, these are definitely fixed to the hub. The propeller according to the present invention allows the manufacturing cost to be considerably reduced. As the blades can be adjusted to the hub according to the desired angle, a plurality of propellers can be made each having a different pitch and diameter. In other words, when the same hub and blades of the same type are combined, according to different pitch angles, a plurality of different propellers can be made, each one being suitable for a particular use. Furthermore, the same hub can be used with blades having different lengths, such that the diameter is also varied.

It is understood that the propeller according to the present invention allows a great assembly modularity. The propeller manufacturer can thus assemble a variety of propellers from a small number of stored components, i.e. different blades and hubs being stocked.

The seats intended to house, at least partially, the blades are circular holes that are formed on the hub outer surface, preferably by means of mechanical processing on the hub. Each blade is provided with a corresponding portion having a circular section which is intended to engage one of these holes. When a blade has been adjusted to the hub in the desired position, it is integrally fixed to the hub by means of welding.

To the purpose of facilitating the welding of the blades, the hub is hollow and the seats are through holes. This configuration allows welding the blades to the hub both at the outer surface thereof, and at the inner surface thereof, with clear advantages in terms of coupling effectiveness.

Preferably, the hub comprises a central portion and an outer ring connected to the middle portion by means of a plurality of spokes. The central portion can be fastened to the drive shaft of a boat. The blade coupling seats are through holes formed in the outer ring, such as in an intermediate position between two subsequent spokes.

This hub configuration is particularly lightweight as compared with a traditional "solid" hub and is very advantageous when the propeller is mounted as the surface propeller on a boat in which the drive axis has a null inclination or however less than 5° (degrees) relative to the waterline. In fact, the hub diameter can be increased as compared with traditional values, without this affecting either the hub weight or, accordingly, the rotating mass in an excessive manner. Thereby, the propeller can be arranged such that only the blades are dipped in the water, with the possibility of reducing the bulk of the boat drive relative to the transom thereof, and at the same time, reducing the number of metallic part in direct contact with water and the rolling resistance of the boat.

The blades can be welded to the hub outer ring at the outer surface thereof and inner surface thereof, i.e. at the edges of the seats. In practice, each blade can be fixed to the hub by means of two weldings, with clear advantages in terms of mechanical strength of the coupling.

The blades can be fastened to the hub between two adjacent spokes and in the vicinity of the spokes. Welding the blades can be thus carried out such that a part of the spoke surface can be used to support the welding. The structural rigidity of the assembled propeller is thus maximized.

Preferably, the hub is obtained by means of stainless steel micro-casting. The blades are also preferably made of stainless steel and hot-pressed to increase the strength thereof.

The propeller according to the present invention can be vented. Furthermore, the hollow hub can be used to discharge the exhaust gas of the relative boat motor. To the purpose of facilitating gas scavenging, the spokes can be inclined in the longitudinal direction relative to the propeller axis of rotation.

The present invention further relates to a method for manufacturing the propeller as described above. The method comprises the steps of inserting said blades in the corresponding seats of the hub, rotating said blades about their axes according to a predefined pitch angle and definitely fixing said blades to the hub.

Preferably, the orientation of the blades in the respective hub seats is carried out using a template. The blades can be provided with a support tang, at the tip of each blade, to facilitate working and centering during welding. When the blades have been centered in the hub seats, a template rotates each of the blades about the seat axis. Thereby, the pitch angle of the blades and the propeller pitch are modified. The template holds the blade in the desired position during the time required for welding. The tang is removed during a subsequent finishing step of the propeller. For example, the free end of each blade can be cut to reduce the length of the blade, and thus, to reduce the diameter of the propeller.

Further aspects and the advantages of the present invention will be better understood from the description below, which is to be considered by way of a non-limiting example with reference to the annexed drawings, in which.

Figure 1:
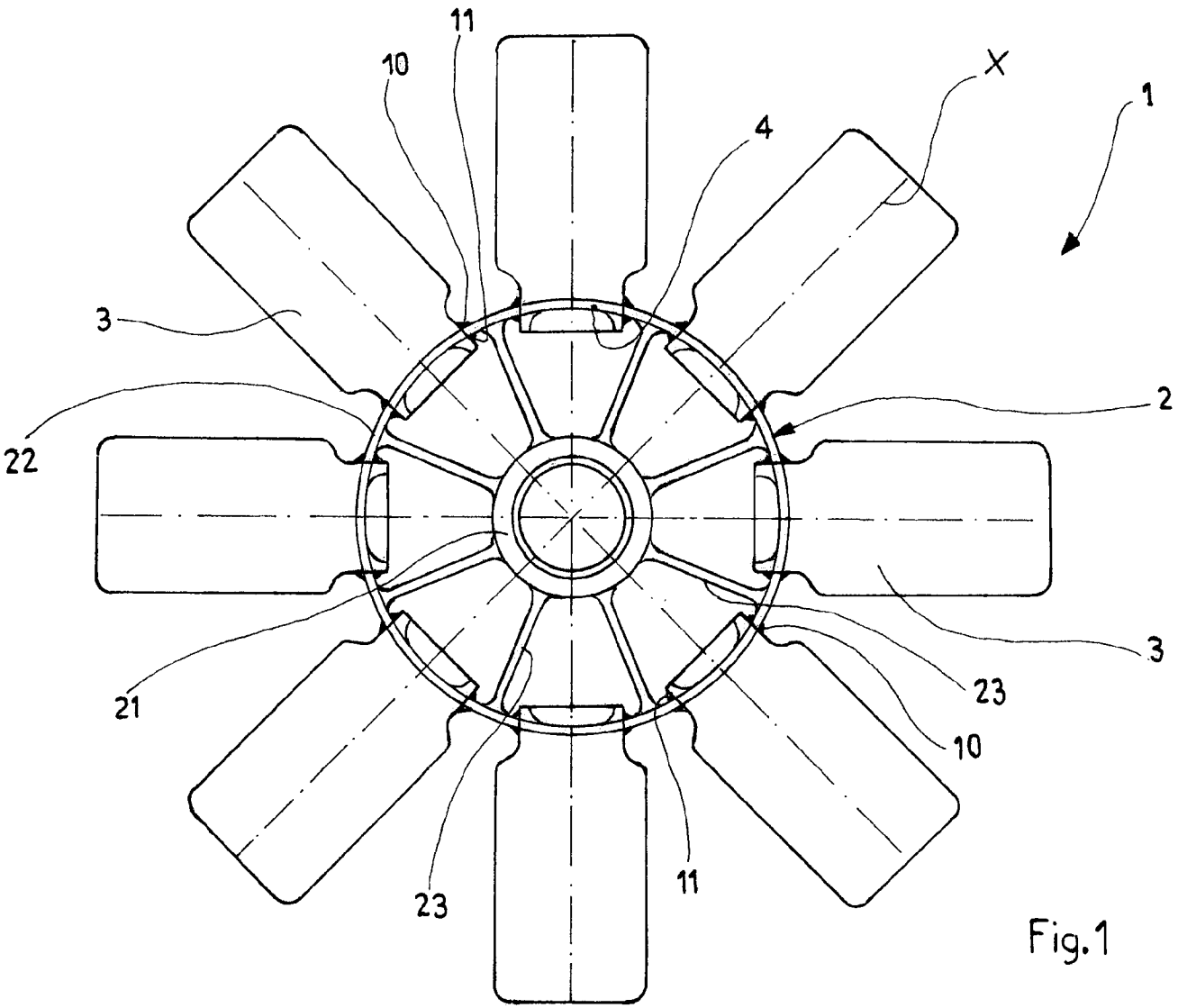
FIG. 1 is a front schematic view of a propeller assembled according to the invention.

FIG. 1 illustrates a propeller 1 according to the present invention, which is provided with a hub 2 and a plurality of blades 3. The blades 3 can be two or more and are manufactured independently of the hub 2, to which they are coupled during the assembly step. For this reason, the hub 2 is provided with seats 4 suitable to house a part of the blades 3. Preferably, as shown in FIG. 1, the axis X of each blade coincides with the axis of the relative seat 4. Advantageously, during the assembly of the propeller 1, the blades 3 can be orientated, i.e. rotated about the axis X before they are definitely fixed to the hub 2.

The hub 2 as illustrated in FIG. 1 comprises a central portion 21 and an outer ring 22. The outer ring 22 is joined to the hub middle portion 21 via a plurality of spokes 23. The hub 2 thus provided is particularly lightweight as compared with traditional hubs having the same outer diameter. The blades 3 are fixed to the outer ring 22 of the hub 2. Advantageously, the coupling between the blades 3 and the outer ring 22 can be accessed either from the outside or inside of the ring 22.

Alternatively, the hub 2 can be a traditional hollow hub, i.e. without central portion and spokes.

Figure 2:
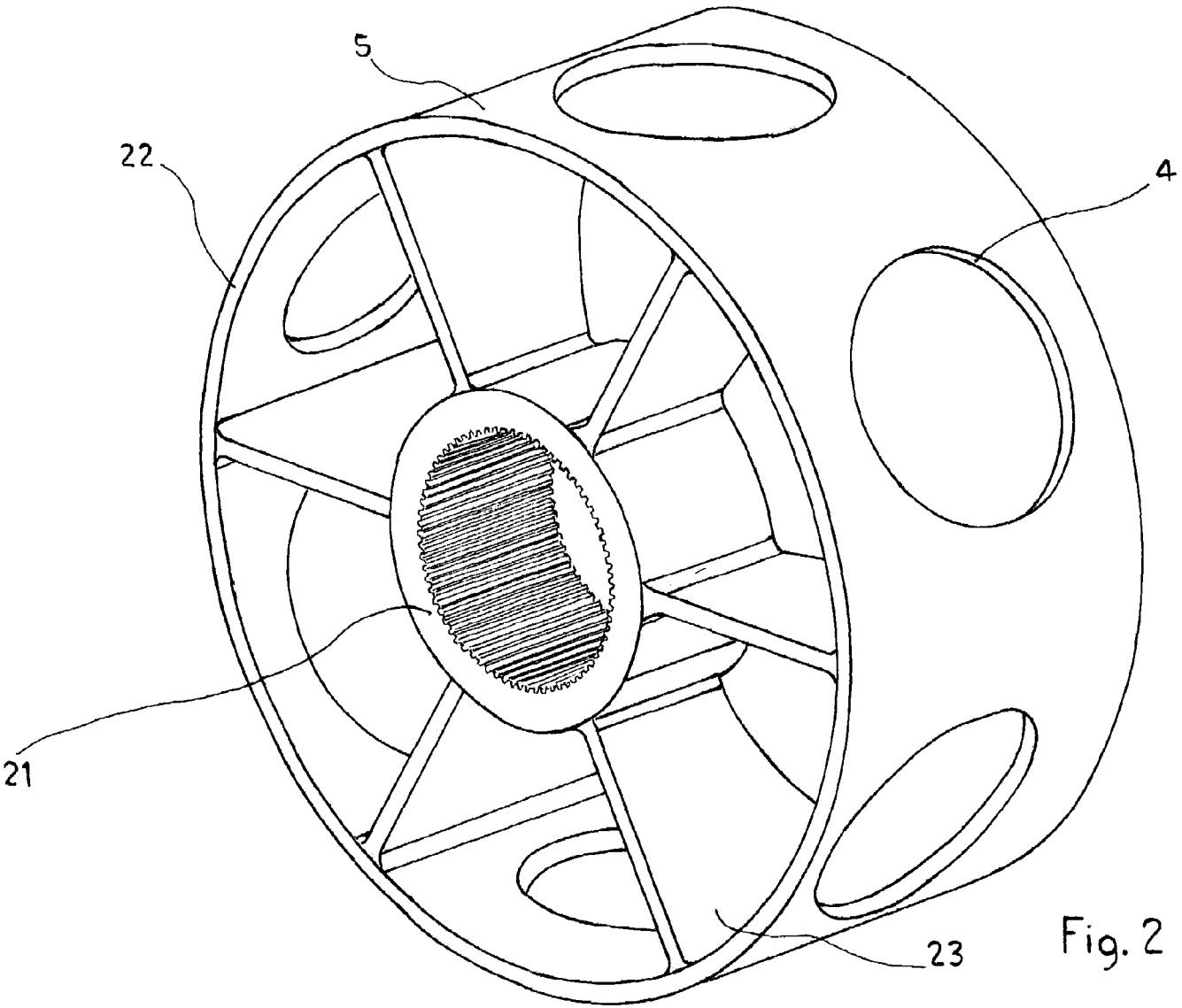
FIG. 2 is a schematic perspective view of a first component of the propeller as shown in FIG. 1.
Figure 3:
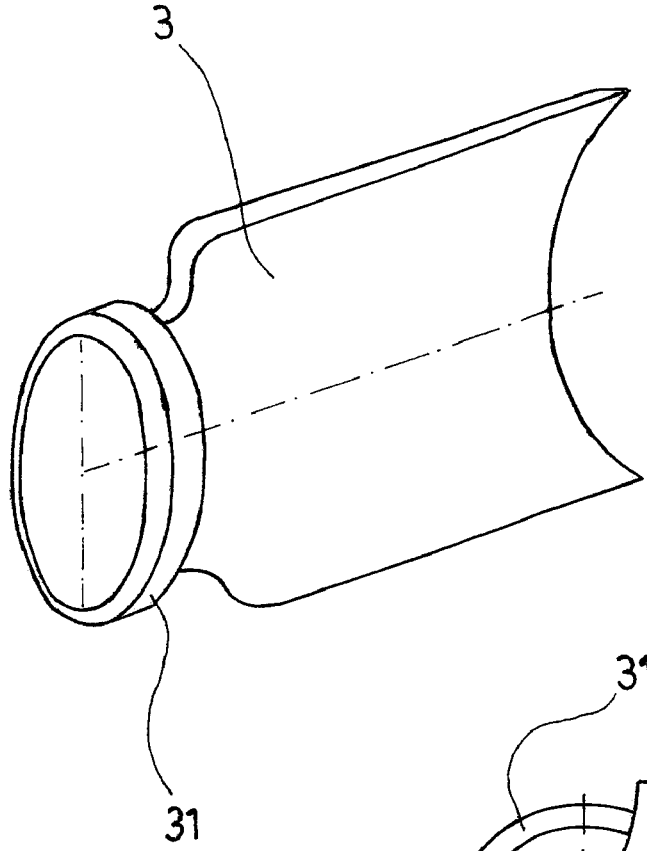
FIG. 3 is a schematic perspective view of a second component of the propeller as shown in FIG. 1.
Figure 4:
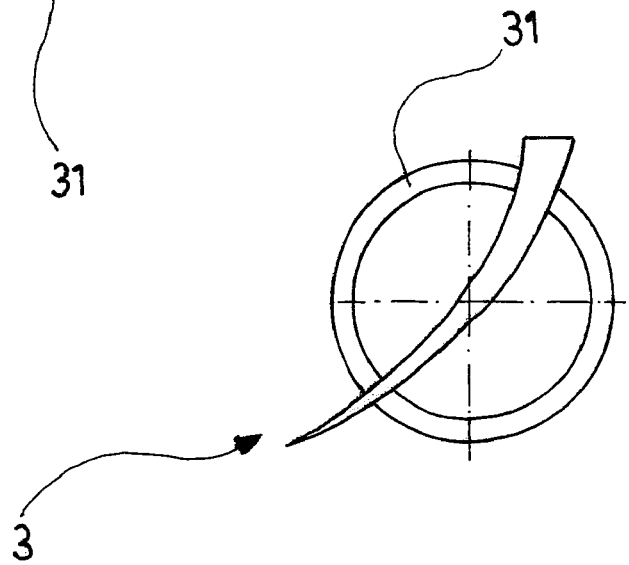
FIG. 4 is a schematic top view of the second component shown in FIG. 3.

FIG. 2 is a schematic view of the outer ring 22 of the hub 2 shown in FIG. 1. The seats 4 are circular through holes formed on the outer surface 5 of the outer ring 22. The holes 4 of the hub 2 are preferably mechanically processed to obtain the perfect coupling with the blades 3 and optimize the quality of the welding. As shown in FIGS. 3 and 4, the blades 3 are provided with a portion 31, which is obtained at the base of the blades 3, for engagement with a seat 4 of the hub 2. The portions 31 as shown in FIGS. 3-4 are circular such as to be coupled with the circular holes 4 of the outer ring 22 shown in FIG. 2.

The circular holes 4 have equal diameter and are regularly spaced along the outer perimeter of the hub 2 or outer ring 22 thereof. The holes 4 can be directly provided upon manufacturing the hub 2, or they can be formed from the solid part of the hub 2 by means of subsequent mechanical processing. The coupling between the engaging portions 31 and the respective seats 4 is such that the blades 3 can be rotated about the axis X during the assembly step of the propeller 1, the pitch of the propeller 1 being thus varied such that the performance and efficiency are adapted to the user's requirements. Preferably, the portions 31 are inserted within the respective seats 4 for centering along the relative axis by means of a suitable insertion means 51. A second tool or template 50 allows the operator to change the pitch angle of the blades. The rotation of the blades 3 about the axis X can be achieved due to the circular shape of the seats 4 and engaging portions 31. The coupling of the portion 31 of each blade with the relative hole can provide an interference. To allow the rotation of the blade 3, this interference must not be excessively high. For example, the clearance (between the portion 31 and hole 4) sufficient to carry out the adjustment of the blades (rotation about axis X) can be obtained by heating the hub 2 and cooling the blades 3, for example, with liquid nitrogen.

It will be understood by those skilled in the art that the blades 3, which are provided with circular portion 31, can be rotated within the circular holes 4 according to any angle comprised between zero and three hundred and sixty degrees (unless an interference occurs between adjacent blades).

Advantageously, by adopting a same type of blades, i.e. blades having defined length and geometry, a plurality of blades can be assembled which have a different pitch.

Figure 5:
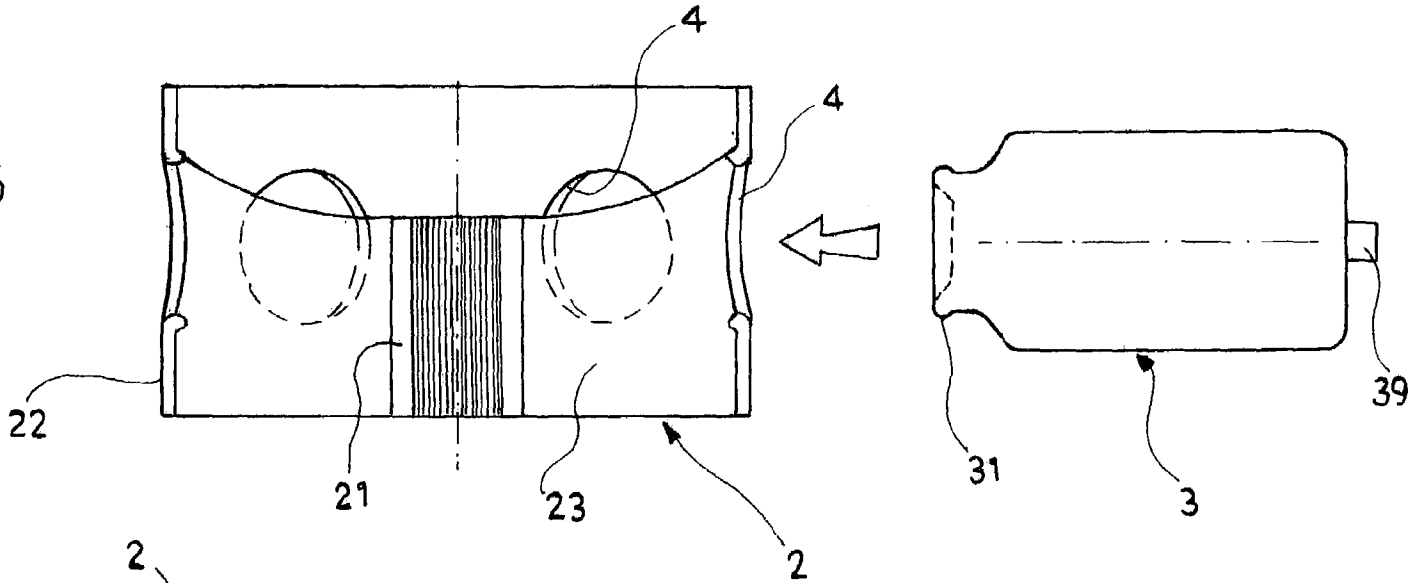
FIG. 5 is a schematic, partially sectional view of the first and second components of the propeller as shown in FIG. 1.
Figure 6:
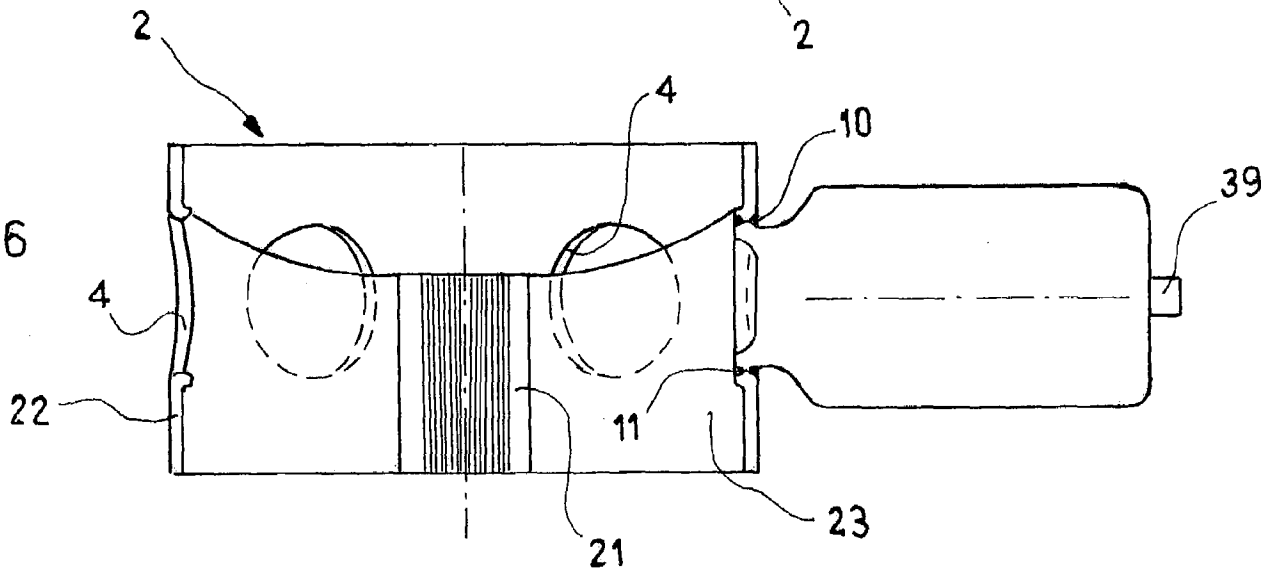
FIG. 6 is a schematic, partially sectional view of the propeller from FIG. 1 in a partially assembled condition.
Figure 7:
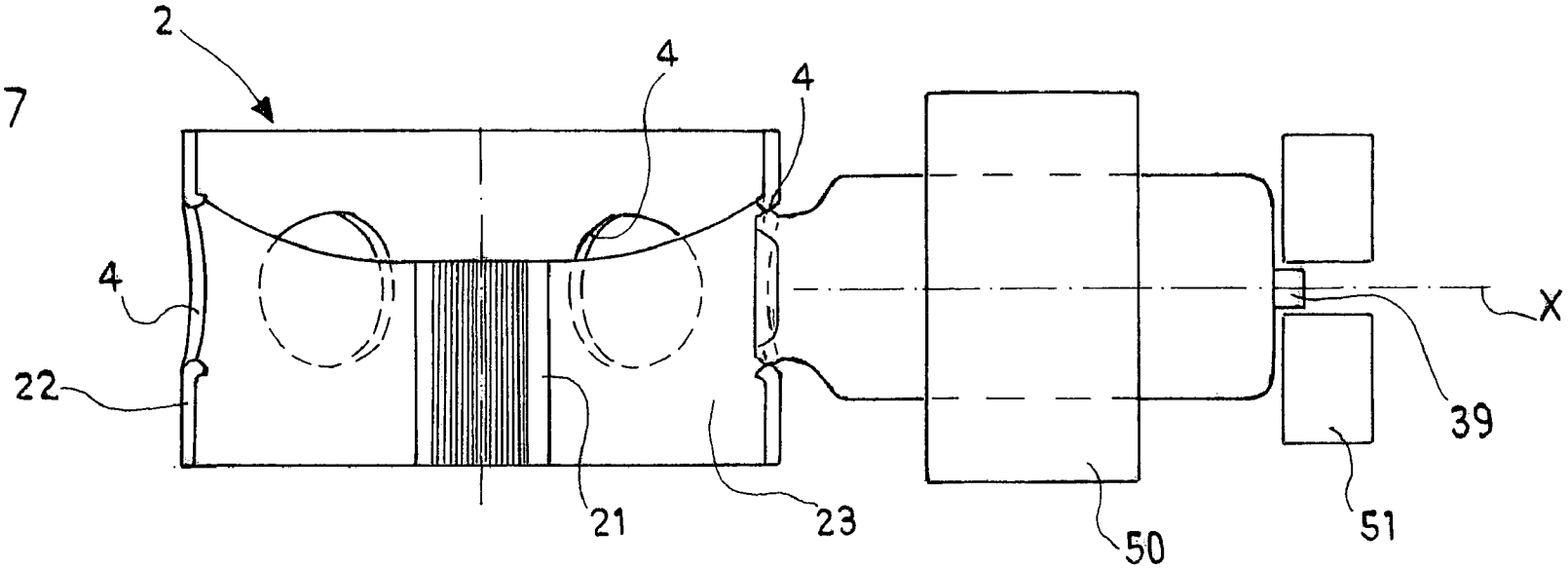
FIG. 7 is a schematic sectional view of a device for assembling the propeller as shown in FIG. 1.

The assembly of the propeller 1 can be operated in a short time, with clear positive effects on the manufacturing cost. FIGS. 5 and 6 schematically illustrate an assembly stage of the propeller 1 as shown in FIGS. 1-4. The portion 31 of each blade 3 is inserted in a seat 4 such that interference exists between the portion 31 and the walls of the hole 4. The blade 3 is thus orientated according to the desired pitch angle. This operation is preferably carried out by means of an external device, such as by means of a template 50. FIG. 7 illustrates in a schematic manner the method for assembling the propeller 1 and particularly the step of coupling and adjusting the blades 3. The blade 3 is first inserted in the hole 4 and aligned along the axis X by means of the device 51 that grips on the tang 39 of the blade 3, and subsequently, due to the adjusting template 50, the blade 3 is rotated until it reaches the required angle. The welding is carried out while the template 50 holds the blade 3 in the desired position. The tang 39 is formed at the tip of the blade 3. When the propeller 1 has been assembled, the tang 39 is removed from the blades 3. For example, the blades 3 are cut by means of mechanical processing.

Figure 8:
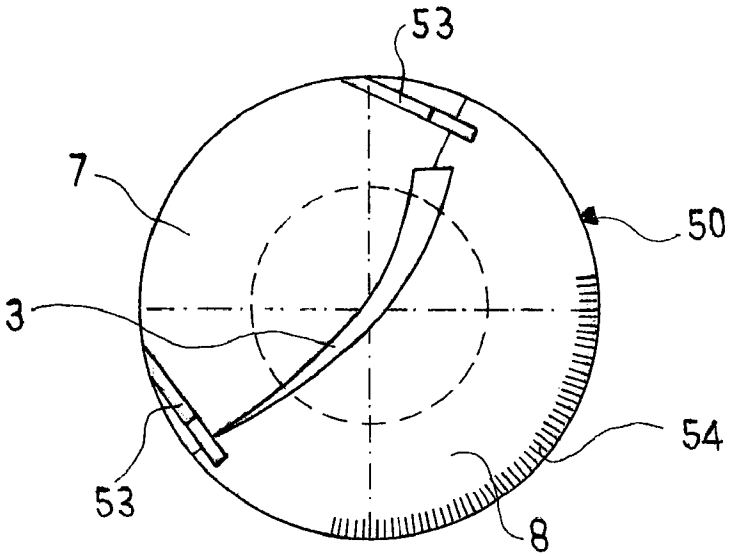
FIG. 8 is a schematic top view of the propeller shown in FIG. 4 during the assembling.

FIG. 8 shows a blade 3 as seen from above, i.e. from the tip to the base and the portions 7 and 8 "closed" on the blade 3, i.e. clamped to the blade 3. The two portions 7 and 8 are firmly clamped with closure pins 53. On the template 50 there is reported a graduated scale 54 that allows checking the angular position of the blade 3 in an accurate manner. Alternatively or in addition, a precision automatic system can rotate the blade to the desired position. The template 50 can be such as to rotate all the blades 3 in the respective seats 4 of the hub 2.

When the pitch angle of a blade 3 has been brought to the desired value, the blade 3 is definitely fixed to the hub 2. Preferably, the blades 3 are welded to the hub 2 as shown in FIG. 6, i.e. via two welding seams 10 and 11 being provided outside and inside the outer ring 22 of the hub 2, respectively. The double welding at the edges of the holes 4 has the advantage of maximizing the mechanical resistance of the blade-hub coupling. Different techniques can be adopted for welding the blades 3 to the hub 2. For example, systems known as electron beam welding, MIG welding or TIG welding can be adopted. The welding seam 10 preferably does not projects past the outer surface of the hub 2, such as shown in FIG. 6.

The hub 2 can be designed to allow the release of the engine exhaust gas of the boat to which the propeller is intended.

The propeller 1 can be of a vented type, i.e. the venting of the blades 3 can be provided with air supplied by suitable members of the boat to which the propeller 1 is mounted.

Advantageously, the propeller 1 according to the present invention can be used as a submerged propeller, but preferably as surface propeller.

The propeller 1 can be assembled in a short time according to the desired pitch, with a clear reduction in the manufacturing cost and wait time in the supply of boat propellers. The construction of the hub 2 and blades 3 is, in fact, independent, i.e. the hub 2 and blades 3 can be manufactured in a modular manner, with different sizes, such as in scale. For example, to a same hub 2, blades 3 can be coupled which have different lengths and the same blades 3 can be coupled with hubs 2 having different diameters and a different number of blades.

The particular configuration of the hub 2 shown in FIG. 1 is particularly advantageous when the propeller is mounted as the surface propeller on a boat of which the drive axis has a null inclination or however less than 5° (degrees) relative to the waterline. In fact, the diameter of the hub 2 can be oversized as compared to what is provided in the traditional propellers, without this affecting the weight of the hub 2 in an excessive manner. Thereby, the propeller 1 can be arranged such that only the blades 3 are submerged in water. This allows reducing the number of the metallic parts in direct contact with the water, with a considerable reduction in the corrosion and drag of the boat.

The propeller according to the present invention is particularly functional when it is aligned to a second, counter-rotating, propeller. In this case, in fact, the hub 2 having a great diameter allows two counter-rotating shafts and the exhaust gas to pass therethrough.

The invention claimed is:

1. A boat propeller comprising a hub and a plurality of separated blades to be integrally coupled within corresponding seats obtained in said hub, wherein said seats are circular, and during assembly of the propeller, said blades can be oriented within said seats, each one about its axis, and wherein said blades are definitively fixed to the hub by welding when a desired pitch angle is obtained, thereby completing assembly of the propeller.

2. The propeller according to claim 1, wherein each of said blades can be oriented in the corresponding seat of said hub according to any angle ranging between zero and three hundred and sixty degrees.

3. The propeller according to claim 2, wherein said seats are circular holes formed on the outer surface of said hub and each of said blades is provided with a corresponding portion having a circular section for engagement with said holes.

4. The propeller according to claim 3, wherein each of said blades can be inserted in the corresponding seat by means of interference fit.

5. The propeller according to claim 1, wherein each of said blades can be oriented in the corresponding seat of said hub according to a sequence of discrete angles, in predefined positions.

6. The propeller according to claim 1, wherein said hub is hollow and said holes are through holes.

7. The propeller according to claim 1, wherein said hub comprises a middle portion and an outer ring connected to the middle portion by means of a plurality of spokes, said holes being through holes formed in said outer ring.

8. The propeller according to claim 7, wherein each of said blades is welded to the corresponding seat at the outer surface and inner surface of said outer ring.

9. The propeller according to claim 8, wherein at least one portion of said blades is welded to one or more spokes of said hub.

10. The propeller according to claim 1, wherein said hub is obtained by means of stainless steel micro-casting.

11. The propeller according to claim 1, wherein said blades are made of micro-cast stainless steel and are hot-pressed.

12. The propeller according to claim 1, wherein said hub is provided with passageways for conveying the exhaust gas produced by the engine of the boat to which said propeller is intended.

13. A method for assembling a propeller according to claim 1, comprising:

inserting said blades in the corresponding seats of the hub, rotating said blades about their axes according to a predefined pitch angle; and definitely fixing said blades to the hub.

14. The method according to claim 13, wherein said blades are rotated with a template.

15. The method according to claim 13, wherein said blades are fixed to said hub by means of a welding of the type selected from electron beam, MIG or TIG welding.

16. Use of a propeller according to claim 1 for propelling boats.

17. A boat including the propeller of claim 1.

* * * * *